US006092483A

United States Patent [19]

Allen et al.

[11] Patent Number: 6,092,483

[45] Date of Patent: Jul. 25, 2000

[54] SPAR WITH IMPROVED VIV PERFORMANCE

[75] Inventors: Donald Wayne Allen, Katy; Dean Leroy Henning, Needville; Stephen W. Balint, Houston; David Wayne McMillan, Deer Park, all of Tex.

[73] Assignee: Shell Oil Company, Houston, Tex.

[21] Appl. No.: 08/997,417

[22] Filed: Dec. 23, 1997

Related U.S. Application Data

[60] Provisional application No. 60/034,469, Dec. 31, 1996.

[51] Int. Cl.[7] ..... B63B 35/44

[52] U.S. Cl. ..... 114/264; 441/28

[58] Field of Search ..... 114/230.13, 264, 114/265, 267; 441/3–5, 6, 28, 1; 405/195.1–198, 224

[56] References Cited

U.S. PATENT DOCUMENTS

| | | | |
|---|---|---|---|
| H611 | 4/1989 | Peace | 114/264 |
| 2,986,889 | 6/1961 | Ludwig | 61/46.5 |
| 3,407,416 | 10/1968 | Brickhouse | 114/267 |
| 3,407,766 | 10/1968 | Bergman et al. | 114/0.5 |
| 3,407,767 | 10/1968 | McClintock et al. | 114/0.5 |
| 3,460,501 | 8/1969 | Silverman | 114/0.5 |
| 3,500,783 | 3/1970 | Johnson, Jr. et al. | 114/0.5 |
| 3,510,692 | 5/1970 | Hufford | 307/284 |
| 3,510,892 | 5/1970 | Monnereau et al. | 9/8 |
| 3,572,041 | 3/1971 | Graaf | 61/46.5 |
| 3,916,633 | 11/1975 | Lovie et al. | 61/46.5 |
| 3,951,086 | 4/1976 | Lown et al. | 114/0.5 D |
| 3,978,804 | 9/1976 | Beynet et al. | 114/0.5 D |
| 4,155,673 | 5/1979 | Yashima | 405/224 |
| 4,312,288 | 1/1982 | Finsterwalder et al. | 114/264 |
| 4,378,179 | 3/1983 | Hasle | 405/227 |
| 4,398,487 | 8/1983 | Ortloff et al. | 114/243 |
| 4,473,323 | 9/1984 | Gregory | 405/224 |
| 4,505,620 | 3/1985 | Andrier | 405/224 |
| 4,630,968 | 12/1986 | Berthet et al. | 405/195 |
| 4,674,918 | 6/1987 | Kalpins | 405/224 |
| 4,685,833 | 8/1987 | Iwamoto | 405/195 |
| 4,700,651 | 10/1987 | Hale | 144/243 |
| 4,702,321 | 10/1987 | Horton | 166/350 |
| 4,768,984 | 9/1988 | de Oliveira et al. | 441/21 |
| 4,829,928 | 5/1989 | Bergman | 114/125 |
| 4,987,846 | 1/1991 | Yamashita et al. | 114/265 |
| 5,558,467 | 9/1996 | Horton | 405/195.1 |
| 5,722,797 | 3/1998 | Horton, III | 405/224 |

FOREIGN PATENT DOCUMENTS

| | | | |
|---|---|---|---|
| 2 540 065 | 8/1984 | France . | |
| 57-4493 | 1/1982 | Japan | 441/6 |
| 2 118 903 | 11/1983 | United Kingdom . | |
| 2118904 | 11/1983 | United Kingdom | 114/264 |
| 2 310 407 | 8/1997 | United Kingdom | B63B 35/44 |

OTHER PUBLICATIONS

F. Joseph Fischer et al., "Current–Induced Oscillations of Cognac Piles During Installation—Prediction and Measurement," Practical Experiences with Flow–Induced Vibrations, Symposium Karlsruhe/Germany, Sep. 3–6, 1979, University of Karlsruhe, pp. 570–581.

J. A. van Santen and K. deWerk, "On the Typical Qualities of SPAR Type Structures for Initial or Permanent Field Development," OTC Paper 2716, Eighth Annual Offshore Technology Conference, Houston, Texas, May 3–6, 1976, 14 pages.

Armin W. Troesch, Associate Professor (Principal Investigator), "Hydrodynamic Forces on Bodies Undergoing Small Amplitude Oscillations in a Uniform Stream" (Completion of existing UM/Sea Grant/Industry consortium project), 19 pages.

*Primary Examiner*—Ed Swinehart
*Attorney, Agent, or Firm*—Mark A. Smith

[57] ABSTRACT

A method for reducing VIV is disclosed for a spar platform having a deck, a cylindrical hull having a buoyant tank assembly, a counterweight and an counterweight spacing structure. The overall aspect ratio of the hull is reduced by providing one or more abrupt changes in hull diameter below the waterline.

10 Claims, 3 Drawing Sheets

FIG. 1
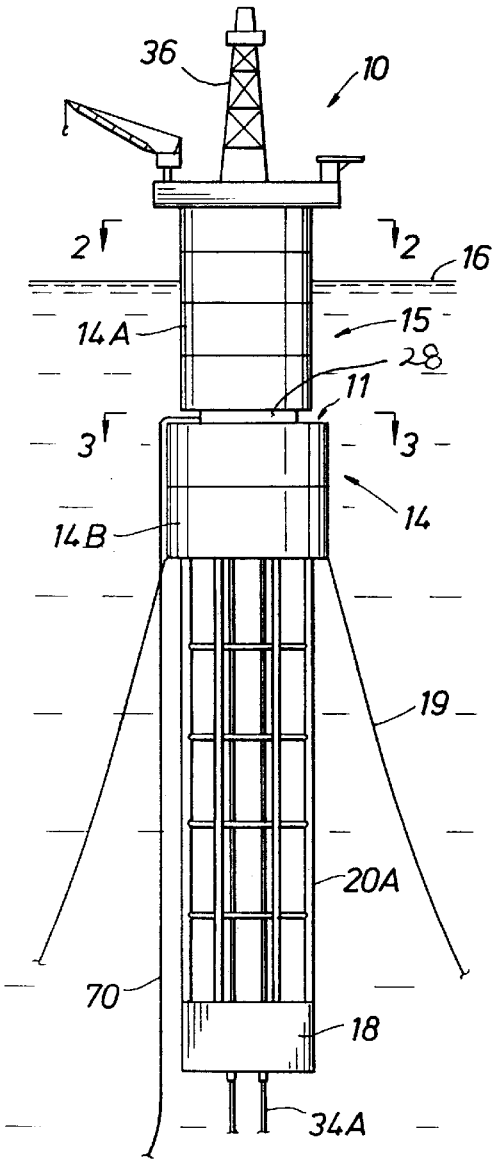
FIG. 3
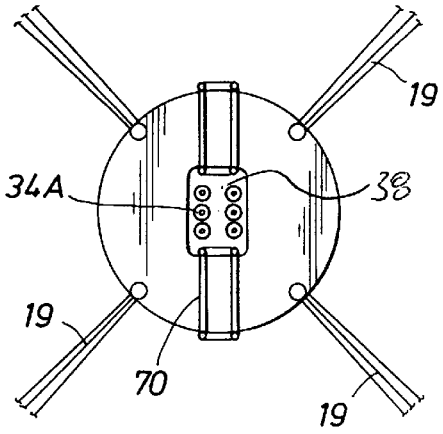
FIG. 4
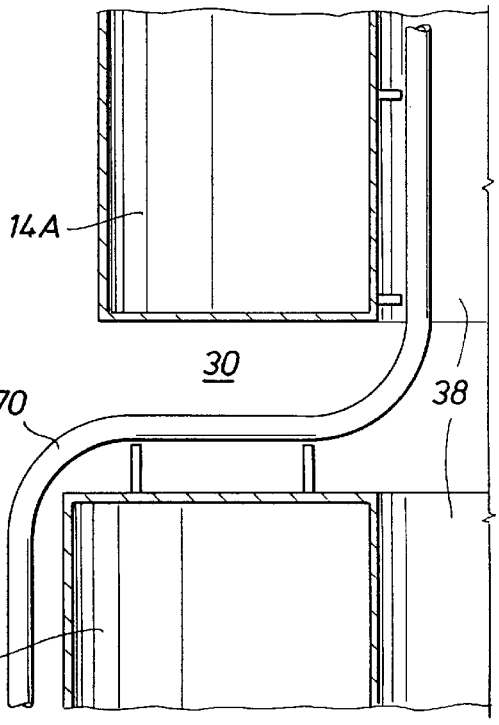
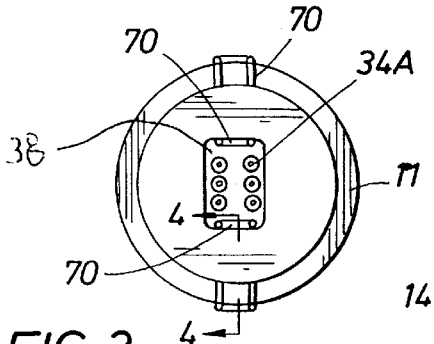
FIG. 2

SPAR WITH IMPROVED VIV PERFORMANCE

This application claims the benefit of U.S. Provisional Application No. 60/034,469, filed Dec. 31, 1996, the entire disclosure of which is hereby incorporated by reference.

BACKGROUND OF THE INVENTION

The present invention relates to a heave resistant, deep-water platform supporting structure known as a "spar." More particularly, the present invention relates to reducing the susceptibility of spars to drag and vortex induced vibrations ("VIV").

Efforts to economically develop offshore oil and gas fields in ever deeper water create many unique engineering challenges. One of these challenges is providing a suitable surface accessible structure. Spars provide a promising answer for meeting these challenges. Spar designs provide a heave resistant, floating structure characterized by an elongated, vertically disposed hull. Most often this hull is cylindrical, buoyant at the top and with ballast at the base. The hull is anchored to the ocean floor through risers, tethers, and/or mooring lines.

Though resistant to heave, spars are not immune from the rigors of the offshore environment. The typical single column profile of the hull is particularly susceptible to VIV problems in the presence of a passing current. These currents cause vortexes to shed from the sides of the hull, inducing vibrations that can hinder normal drilling and/or production operations and lead to the failure of the anchoring members or other critical structural elements.

Helical strakes and shrouds have been used or proposed for such applications to reduce vortex induced vibrations. Strakes and shrouds can be made to be effective regardless of the orientation of the current to the marine element. But shrouds and strakes materially increase the drag on such large marine elements.

Thus, there is a clear need for a low drag, VIV reducing system suitable for deployment in protecting the hull of a spar type offshore structure.

A SUMMARY OF THE INVENTION

A present invention is a method for reducing VIV in a spar platform having a deck, a cylindrical hull having a buoyant tank assembly, a counterweight and an counterweight spacing structure, the method comprising reducing the aspect ratio of the hull by providing one or more abrupt changes in hull diameter below the waterline.

BRIEF DESCRIPTION OF THE DRAWINGS

The description above, as well as further advantages of the present invention will be more fully appreciated by reference to the following detailed description of the illustrated embodiments which should be read in conjunction with the accompanying drawings in which:

FIG. 1 is a side elevational view of an alternate embodiment of a spar platform with spaced buoyancy in accordance with the present invention;

FIG. 2 is a cross sectional view of the spar platform of FIG. 1 taken at line 2—2 in FIG. 1;

FIG. 3 cross sectional view of the spar platform of FIG. 2 taken at line 3—3 in FIG. 1;

FIG. 4 is a sectional view of the spar platform of FIG. 1 taken at line 4—4 in FIG. 2;

DETAILED DESCRIPTION OF ILLUSTRATIVE EMBODIMENTS

Figure 6:
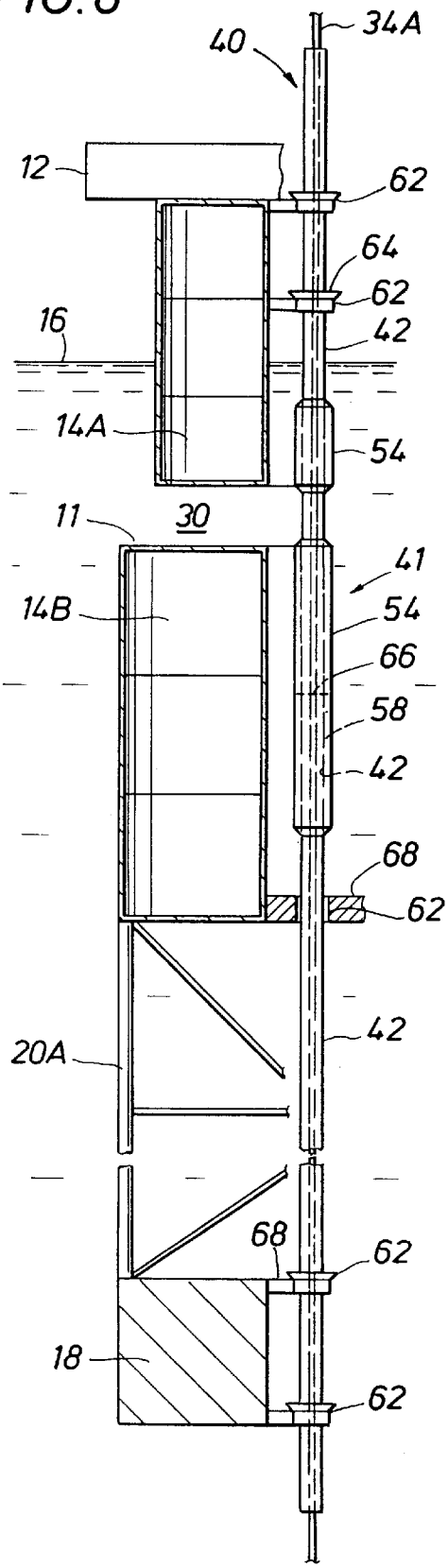
FIG. 6 is a side elevational view of a riser system deployed in an embodiment of the present invention.

FIG. 1 illustrates a spar 10 in accordance with the present invention. Spars are a broad class of floating, moored offshore structure characterized in that they are resistant to heave motions and present an elongated, vertically oriented hull 14 which is buoyant at the top, here buoyant tank assembly 15, and is ballasted at its base, here counterweight 18, which is separated from the top through a middle or counterweight spacing structure 20.

Such spars may be deployed in a variety of sizes and configuration suited to their intended purpose ranging from drilling alone, drilling and production, or production alone. FIGS. 1–4 illustrate a drilling and production spar, but those skilled in the art may readily adapt appropriate spar configurations in accordance with the present invention for either drilling or production operations alone as well in the development of offshore hydrocarbon reserves.

In the illustrative example of FIGS. 1 and 2, spar 10 supports a deck 12 with a hull 14 having a plurality of spaced buoyancy sections, here first or upper buoyancy section 14A and second or lower buoyancy section 14B. These buoyancy sections are separated by buoyant section spacing structure 28 to provide a substantially open, horizontally extending vertical gap 30 between adjacent buoyancy sections. Cylindrical hull 14 is divided into sections having abrupt changes in diameter below the water line. Here, adjacent buoyancy sections have unequal diameters and divide the buoyant tank assembly 15 into two sections separated by a step transition 11 in a substantially horizontal plane.

A counterweight 18 is provided at the base of the spar and the counterweight is spaced from the buoyancy sections by a counterweight spacing structure 20. Counterweight 18 may be in any number of configurations, e.g., cylindrical, hexagonal, square, etc., so long as the geometry lends itself to connection to counterweight spacing structure 20. In this embodiment, the counterweight is rectangular and counterweight spacing structure is provided by a substantially open truss framework 20A.

Mooring lines 26 secure the spar platform over the well site at ocean floor 22. In this embodiment the mooring lines are clustered (see FIG. 3) and provide characteristics of both taut and catenary mooring lines with buoys 24 included in the mooring system (not shown). The mooring lines terminate at their lower ends at an anchor system such as piles secured in the seafloor (not shown). The upper end of the mooring lines may extend upward through shoes, pulleys, etc. to winching facilities on deck 12 or the mooring lines may be more permanently attached at their departure from hull 14 at the base of buoyant tank assembly 15.

A basic characteristic of the spar type structure is its heave resistance. However, the typical elongated, cylindrical hull elements, whether the single caisson of the "classic" spar or the buoyant tank assembly 15 of a truss-style spar, are very susceptible to vortex induced vibration ("VIV") in the presence of a passing current. These currents cause vortexes to shed from the sides of the hull 14, inducing vibrations that can hinder normal drilling and/or production operations and lead to the failure of the risers, mooring line connections or other critical structural elements. Premature fatigue failure is a particular concern.

Prior efforts at suppressing VIV in spar hulls have centered on strakes and shrouds. However both of these efforts have tended to produce structures with having high drag coefficients, rendering the hull more susceptible to drift. This commits substantial increases in the robustness required in the anchoring system. Further, this is a substantial expense for structures that may have multiple elements extending from near the surface to the ocean floor and which are typically considered for water depths in excess of half a mile or so.

The present invention reduces VIV from currents, regardless of their angle of attack, by dividing the cylindrical elements in the spar abrupt changes in the diameter which substantially disrupts the correlation of flow about the combined cylindrical elements, thereby suppressing VIV effects on the spar hull. In this embodiment, this change in diameter combines with substantially open, horizontally extending, vertical gaps 30 at select intervals along the length of the cylindrical hull. Providing one or more gaps 30 also helps reduce the drag effects of current on spar hull 14.

Production risers 34A connect wells or manifolds at the seafloor (not shown) to surface completions at deck 12 to provide a flowline for producing hydrocarbons from subsea reservoirs. Here risers 34A extend through an interior or central moonpool 38 illustrated in the cross sectional views of FIGS. 2 and 3.

Figure 5:
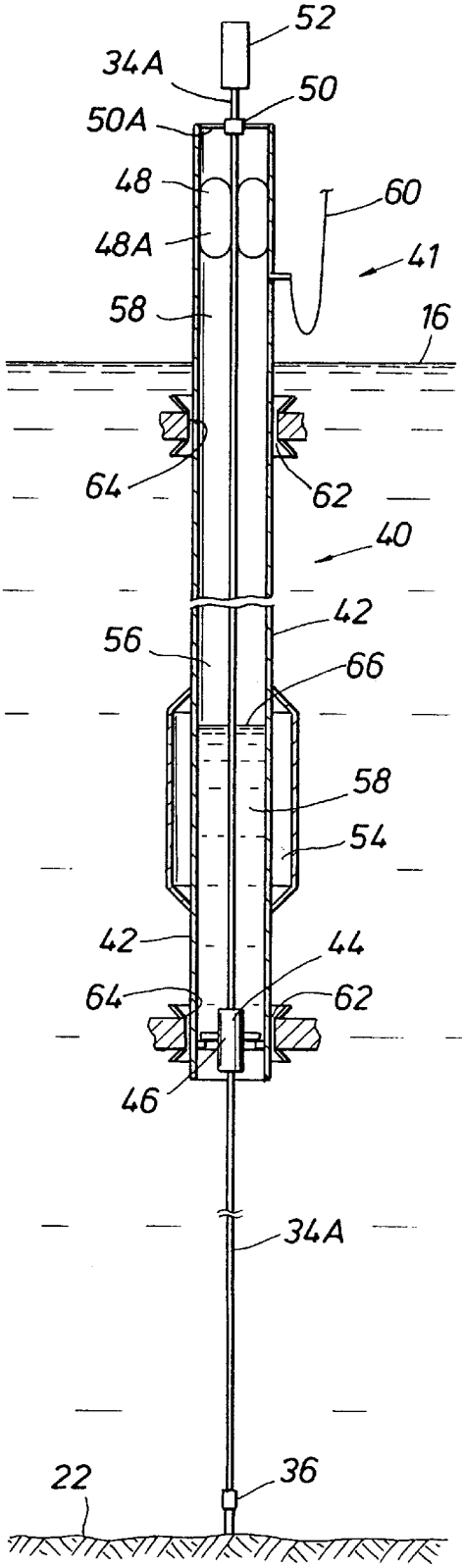
FIG. 5 is a schematically rendered cross sectional view of a riser system useful with embodiments of the present invention.

Spar platforms characteristically resist, but do not eliminate heave and pitch motions. Further, other dynamic response to environmental forces also contribute to relative motion between risers 34A and spar platform 10. Effective support for the risers which can accommodate this relative motion is critical because a net compressive load can buckle the riser and collapse the pathway within the riser necessary to conduct well fluids to the surface. Similarly, excess tension from uncompensated direct support can seriously damage the riser. FIGS. 5 and 6 illustrate a deepwater riser system 40 which can support the risers without the need for active, motion compensating riser tensioning systems.

FIG. 5 is a cross sectional schematic of a deepwater riser system 40 constructed in accordance with the present invention. Within the spar structure, production risers 34A run concentrically within buoyancy can tubes 42. One or more centralizers 44 secure this positioning. Here centralizer 44 is secured at the lower edge of the buoyancy can tube and is provided with a load transfer connection 46 in the form of an elastomeric flexjoint which takes axial load, but passes some flexure deformation and thereby serves to protect riser 34A from extreme bending moments that would result from a fixed riser to spar connection at the base of spar 10. In this embodiment, the bottom of the buoyancy can tube is otherwise open to the sea.

The top of the buoyancy tube can, however, is provided with an upper seal 48 and a load transfer connection 50. In this embodiment, the seal and load transfer function are separated, provided by inflatable packer 48A and spider 50A, respectively. However, these functions could be combined in a hanger/gasket assembly or otherwise provided. Riser 34A extends through seal 48 and connection 50 to present a Christmastree 52 adjacent production facilities, not shown. These are connected with a flexible conduit, also not shown. In this embodiment, the upper load transfer connection assumes a less axial load than lower load transfer connection 46 which takes the load of the production riser therebeneath. By contrast, the upper load connection only takes the riser load through the length of the spar, and this is only necessary to augment the riser lateral support provided the production riser by the concentric buoyancy can tube surrounding the riser.

External buoyancy tanks, here provided by hard tanks 54, are provided about the periphery of the relatively large diameter buoyancy can tube 42 and provide sufficient buoyancy to at least float an unloaded buoyancy can tube. In some applications it may be desirable for the hard tanks or other form of external buoyancy tanks 54 to provide some redundancy in overall riser support.

Additional, load bearing buoyancy is provided to buoyancy can assembly 41 by presence of a gas 56, e.g., air or nitrogen, in the annulus 58 between buoyancy can tube 42 and riser 34A beneath seal 48. A pressure charging system 60 provides this gas and drives water out the bottom of buoyancy can tube 42 to establish the load bearing buoyant force in the riser system.

Load transfer connections 46 and 50 provide a relatively fixed support from buoyancy can assembly 41 to riser 34A. Relative motion between spar 10 and the connected riser/buoyancy assembly is accommodated at riser guide structures 62 which include wear resistant bushings within riser guides tubes 64. The wear interface is between the guide tubes and the large diameter buoyancy can tubes and risers 34A are protected.

FIG. 6 is a side elevational view of a deepwater riser system 40 in a partially cross-sectioned spar 10 having two buoyancy sections 14A and 14B, of unequal diameter, separated by a gap 30. A counterweight 18 is provided at the base of the spar, spaced from the buoyancy sections by a substantially open truss framework 20A.

The relatively small diameter production riser 34A runs through the relatively large diameter buoyancy can tube 42. Hard tanks 54 are attached about buoyancy can tube 42 and a gas injected into annulus 58 drives the water/gas interface 66 within buoyancy can tube 42 far down buoyancy can assembly 41.

Buoyancy can assembly 41 is slidingly received through a plurality of riser guides 62. The riser guide structure provides a guide tube 64 for each deepwater riser system 40, all interconnected in a structural framework connected to hull 14 of the spar. Further, in this embodiment, a significant density of structural conductor framework is provided at such levels to tie conductor guide structures 62 for the entire riser array to the spar hull. Further, this can include a plate 68 across moonpool 38.

The density of conductor flaming and/or horizontal plates 68 serve to dampen heave of the spar. Further, the entrapped mass of water impinged by this horizontal structure is useful in otherwise tuning the dynamics of the spar, both in defining harmonics and inertia response. Yet this virtual mass is provided with minimal steel and without significantly increasing the buoyancy requirements of the spar.

Horizontal obstructions across the moonpool of a spar with spaced buoyancy section may also improve dynamic response by impeding the passage of dynamic wave pressures through gap 30, up moonpool 38. Other placement levels of the conductor guide framework, horizontal plates, or other horizontal impinging structure may be useful, whether across the moonpool, as outward projections from the spar, or even as a component of the relative sizes of the upper and lower buoyancy sections, 14A and 14B, respectively.

Further, vertical impinging surfaces such as the additional of vertical plates at various levels in open truss framework 20A may similarly enhance pitch dynamics for the spar with effective entrapped mass.

Another optional feature of this embodiment is the absence of hard tanks 54 adjacent gap 30. Gap 30 in this spar design also contributes to control of vortex induced vibration ("VIV") on the cylindrical buoyancy sections 14 by dividing the aspect ratio (diameter to height below the water line) with two, spaced buoyancy sections 14A and 14B having similar volumes and, e.g., a separation of about 10% of the diameter of the upper buoyancy section. Further, the gap reduces drag on the spar, regardless of the direction of current. Both these benefits requires the ability of current to pass through the spar at the gap. Therefore, reducing the outer diameter of a plurality of deepwater riser systems at this gap may facilitate these benefits.

Another benefit of gap 30 is that it allows passage of import and export steel catenary risers 70 mounted exteriorly of lower buoyancy section 14B to the moonpool 38. See FIG. 4 and also FIGS. 2–3. This provides the benefits and convenience of hanging these risers exterior to the hull of the spar, but provide the protection of having these inside the moonpool near the water line 16 where collision damage presents the greatest risk and provides a concentration of lines that facilitates efficient processing facilities. Import and export risers 70 are secured by standoffs and clamps above their major load connection to the spar. Below this connection, they drop in a catenary lie to the seafloor im a manner that accepts vertical motion at the surface more readily than the vertical access production risers 34A.

Supported by hard tanks 54 alone (without a pressure charged source of annular buoyancy), unsealed and open top buoyancy can tubes 42 can serve much like well conductors on traditional fixed platforms. Thus, the large diameter of the buoyancy can tube allows passage of equipment such as a guide funnel and compact mud mat in preparation for drilling, a drilling riser with an integrated tieback connector for drilling, surface casing with a connection pod, a compact subsea tree or other valve assemblies, a compact wireline lubricator for workover operations, etc. as well as the production riser and its tieback connector. Such other tools may be conventionally supported from a derrick, gantry crane, or the like throughout operations, as is the production riser itself during installation operations.

After production riser 34A is run (with centralizer 44 attached) and makes up with the well, seal 48 is established, the annulus is charged with gas and seawater is evacuated, and the load of the production riser is transferred to the buoyancy can assembly 41 as the deballasted assembly rises and load transfer connections at the top and bottom of assembly 41 engage to support riser 34A.

Figure 7:
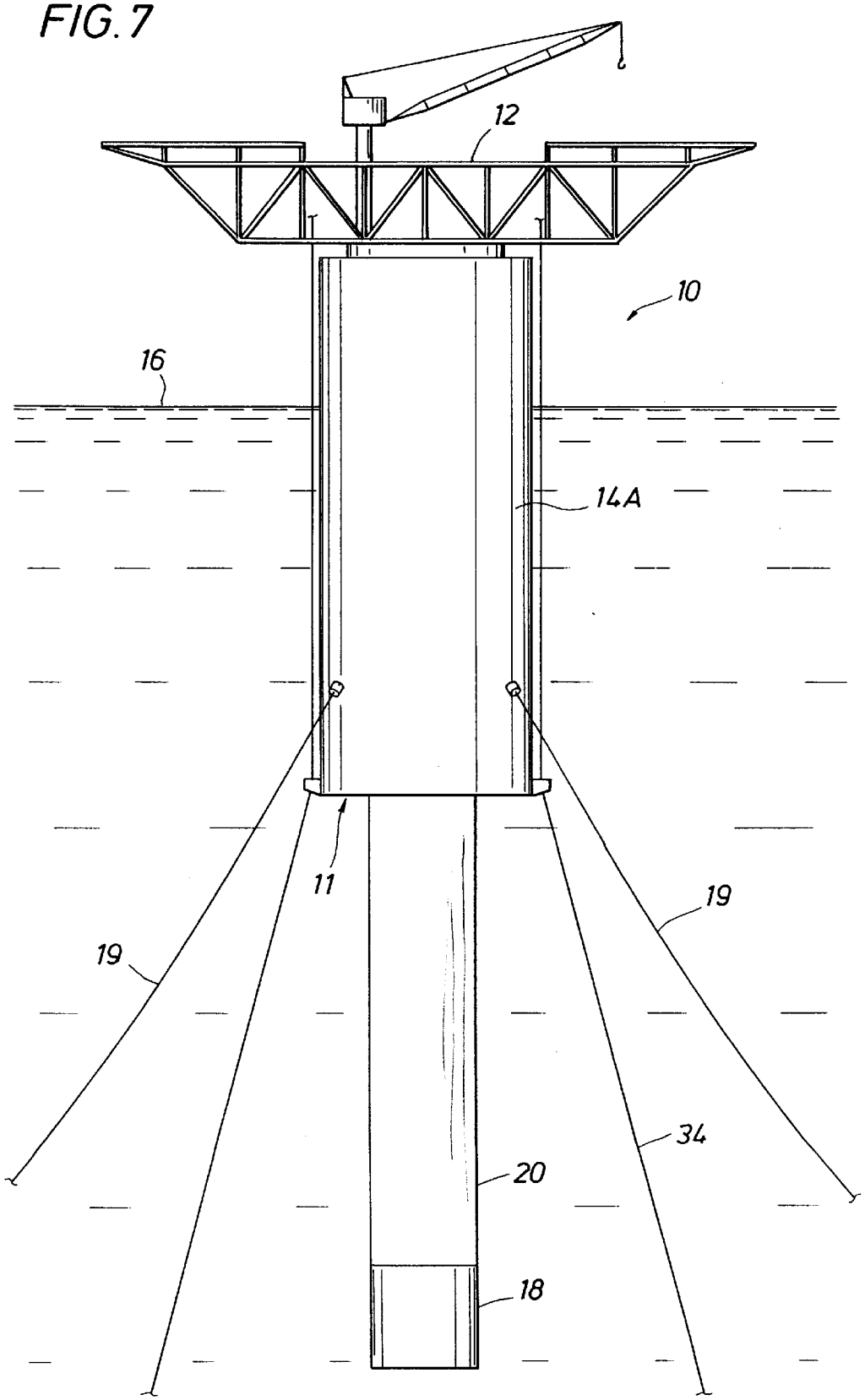
FIG. 7 is a side elevational view of another embodiment of the present invention.

It should be understood that although most of the illustrative embodiments presented here deploy the present invention in spars with interior moon pools 38, a substantially open truss 20A separating the buoyant sections from the counterweight 18, substantially open gaps in the buoyant tank assembly, and an increase in the diameter of the hull below the waterline; it is clear that the VIV suppression of the present invention is not limited to this sort of spar embodiment. Such measures may be deployed for spars having no moonpool and exteriorly run vertical access production risers 34A or may be deployed in spars 10 in which the buoyant tank assembly 15, counterweight spacing structure 20, and counterweight 18 are all provided in the profile of a elongated cylinders, without gaps, or with decreases in diameter below the waterline. See, for example, FIG. 7 illustrating a combinations of these alternative configuration aspects.

Further, other modifications, changes and substitutions are intended in the foregoing disclosure and in some instances some features of the invention will be employed without a corresponding use of other features. Accordingly, it is appropriate that the appended claims be construed broadly and in the manner consistent with the spirit and scope of the invention herein.

What is claimed is:

1. A method for reducing vortex induced vibrations in a spar platform for developing offshore hydrocarbon reserves. the spar platform having a deck, a cylindrical hull having a buoyant tank assembly, a counterweight and an counterweight spacing structure, the method comprising reducing the aspect ratio of the hull by providing one or more abrupt changes in hull diameter below the waterline.

2. A method for reducing vortex induced vibrations in a spar platform in accordance with claim 1 wherein providing an abrupt change in hull diameter comprises stepping down the hull diameter on a substantially horizontal plane.

3. A method for reducing vortex induced vibrations in a spar platform in accordance with claim 1 wherein providing an abrupt change in hull diameter comprises stepping up the hull diameter on a substantially horizontal plane.

4. A method for reducing vortex induced vibrations in a spar platform in accordance with claim 1 wherein reducing the aspect ratio of the spar further comprises providing one of the abrupt changes in hull diameter in the buoyant tank assembly between vertically aligned cylindrical buoyant sections and sizing the change between about 40 and 80% of the larger diameter.

5. A method for reducing vortex induced vibrations in a spar platform in accordance with claim 1 further comprising reducing vortex induced vibrations and drag by forming the counterweight spacing structure from a horizontally open truss framework.

6. A spar platform for developing offshore hydrocarbon reserves in deployment at a location subject to at least transitory currents causing a flow there past comprising:

a deck;

a buoyant tank assembly, comprising:

a first cylindrical buoyant section connected to the deck;

a second cylindrical buoyant section disposed beneath the first buoyant section; and an abrupt change in relative diameters between the first and second buoyant sections in a manner that will substantially disrupt a correlation in the flow about the buoyant tank assembly so as to mitigate vortex induced vibration effects;

a counterweight; and a counterweight spacing structure connecting the counterweight to the buoyant tank assembly.

7. A spar platform in accordance with claim 6 wherein the abrupt change in diameters between the first and second buoyant sections is between about 40 and 80% of the larger diameter.

8. A spar platform in accordance with claim 6 wherein the abrupt change in diameter is a relative reduction in diameter between the first and second buoyant sections and presents a substantially horizontal surface.

9. A spar platform in accordance with claim 6 wherein the counterweight spacing structure is a truss.

10. A spar platform in accordance with claim 6 wherein the abrupt change in diameter is a relative increase in diameter between the first and second buoyant sections and presents a substantially horizontal surface.

* * * * *